US008801129B2

(12) United States Patent
Link et al.

(10) Patent No.: US 8,801,129 B2
(45) Date of Patent: Aug. 12, 2014

(54) METHOD OF ADJUSTING DROP VOLUME

(75) Inventors: Robert Link, Webster, NY (US); James Lee Bello, Rochester, NY (US); Todd Russell Griffin, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 169 days.

(21) Appl. No.: 13/592,443

(22) Filed: Aug. 23, 2012

(65) Prior Publication Data

US 2013/0235103 A1 Sep. 12, 2013

Related U.S. Application Data

(60) Provisional application No. 61/608,674, filed on Mar. 9, 2012.

(51) Int. Cl.

| | |
|---|---|
| ***B41J 29/38*** | (2006.01) |
| ***B41J 2/07*** | (2006.01) |
| ***B41J 2/03*** | (2006.01) |
| ***B41J 2/075*** | (2006.01) |

(52) U.S. Cl.
CPC ... *B41J 2/03* (2013.01); *B41J 2/075* (2013.01)
USPC ..... 347/11; 347/74

(58) Field of Classification Search
USPC ..... 347/11, 15, 73–75
See application file for complete search history.

(56) References Cited

U.S. PATENT DOCUMENTS

| | | | | |
|---|---|---|---|---|
| 4,068,241 | A | 1/1978 | Yamada | |
| 4,636,808 | A | 1/1987 | Herron | |
| 6,079,821 | A | 6/2000 | Chwalek et al. | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 * | 7/2003 | Jeanmaire et al. | 347/77 |
| 6,685,293 | B2 * | 2/2004 | Junhua | 347/14 |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,261,396 | B2 * | 8/2007 | Hawkins et al. | 347/74 |
| 7,828,420 | B2 | 11/2010 | Fagerquist et al. | |
| 7,938,516 | B2 | 5/2011 | Piatt et al. | |
| 8,087,740 | B2 | 1/2012 | Piatt et al. | |
| 2002/0085071 | A1 | 7/2002 | Jeanmaire et al. | |

* cited by examiner

*Primary Examiner* — Shelby Fidler
*Assistant Examiner* — Tracey McMillion
(74) *Attorney, Agent, or Firm* — Peyton C. Watkins

(57) ABSTRACT

A method for operating a jetting module includes applying to a drop forming mechanism a sequence of drop formation waveforms in which a small-drop waveform applied after another identical small-drop waveform causes a small drop of volume Vs to be formed; applying a large-drop waveform after another identical large-drop waveform causes a large drop of volume $V_L$ to be formed, and applying a large-drop waveform adjacent to a small-drop waveform can be done in a way that produces a large drop having a volume $V_{L2}$, where $V_{L2}$ is different than $V_L$ and a small drop of volume $V_{S2}$, where $V_{S2}$ is different than Vs.

14 Claims, 8 Drawing Sheets

METHOD OF ADJUSTING DROP VOLUME

CROSS REFERENCE TO RELATED APPLICATION

This application claims the benefit of U.S. Provisional Patent Application No. 61/608,674, filed Mar. 9, 2012, entitled "Method for Altering Drop Size in a Continuous Inkjet Printer" by Robert Link et al, which is incorporated herein by reference in its entirety.

FIELD OF THE INVENTION

This invention relates generally to the field of digitally controlled printing devices, and in particular to continuous printing systems in which a liquid stream is selectively broken off into drops having a small volume and drops having a large volume.

BACKGROUND OF THE INVENTION

Printing systems that deflect drops using a gas flow are known; see, for example, U.S. Pat. No. 4,068,241, issued to Yamada, on Jan. 10, 1978. Such printing systems rely on the ability to generate distinct sizes of drop—a "print drop" of a given size, and a "catch drop" of distinctly different size. Differential deflection of the drops of different sizes is employed to cause print drops to impinge on the substrate and the catch drops to be collected and re-circulated through the ink delivery system.

In thermally stimulated continuous inkjet printing (see, for example Jeanmaire et al. U.S. Patent Application Publication No. 20020085071 A1 and Chwalek et al, In U.S. Pat. No. 6,079,821), periodic heat pulses are applied to individual heaters embedded in a nozzle array. The periodic heat pulses drive capillary break-up of jets formed at each nozzle to produce an array of drops. The period of the pulse waveform determines the ultimate size of drop formed after jet break-up. Because the jet responds most sensitively to disturbances at a characteristic frequency $f_R$ known as the Rayleigh frequency, drops are most effectively produced at a fundamental size corresponding to a volume of fluid given by $\pi r^2 U/f_R$, where r is the jet radius and U is the jet velocity.

In U.S. Pat. No. 6,851,796, which issued on Feb. 8, 2005, an ink drop forming mechanism selectively creates a stream of ink drops having a plurality of different volumes traveling along a first path. An air flow directed across the stream of ink drops interacts with the stream of ink drops. This interaction deflects smaller drops more than larger drops and thereby separates ink drops having one volume from ink drops having other volumes.

As the drop selection mechanism described above depends on drop size, it is necessary for large-volume drops to be fully formed before being exposed to the deflection air flow. Consider, for example, a case where the large-volume drop is to have a volume equal to four small-volume drops. It is often seen during drop formation that the portion of the ink stream that is to form the large-volume drop will separate from the main stream as desired, but will then break apart before coalescing to form the large-volume drop. It is necessary for this coalescence to be complete prior to passing through the drop deflecting air flow. Otherwise the separate fragments that are to form the large-volume drop will be deflected by an amount greater than that of a single large-volume drop. Similarly, the small-volume drops must not merge in air before having past the deflection air flow. If separate small-volume drops merge, they will be deflected less than desired.

The distance over which the large-volume drop forms upon coalescence of is fragments is known as the drop formation length (DFL), denoted herein as $L_D$. The details of the large-drop waveform and the physical properties of the jet determine the size of $L_D$. For the purposes of printing, smaller drop formation lengths are advantageous, as the drops are then available for size separation at distances closer to the nozzle plate, and the distance over which the drops must travel prior to separation is reduced. Thus a smaller drop formation length helps reduce the size of the printhead and reduces the risk of incomplete large drop formation and reduces the risk of unintended merging of small drops.

It has been found that ink coverage levels are excessive when printing on certain print media, resulting loss of acuity and discernable gray levels. While the ink coverage level can be reduced through the use of smaller nozzles or by reducing the ink pressure or increasing the frequency of drop formation, these options have shortcomings. Conversely, on other substrates the ink coverage levels can be insufficient, resulting in lack of optical density and voids in the printed regions. While the ink coverage level can be altered through the use of different nozzles sizes or by adjusting the ink pressure or the frequency of drop formation, these options can also have shortcomings. If different nozzle sizes are to be used for different print media, then it would be necessary to produce and maintain an inventory of a number of distinct printheads each having a distinct nozzle size. Reducing the ink pressure or raising the frequency of drop formation can result in reducing the stimulation perturbation wavelengths toward the Rayleigh cutoff limit. As the perturbation wavelengths are reduced toward the Rayleigh cutoff limit, the drop formation can become excessively sensitive to small changes in ink properties, nozzle size, ink pressure, and stimulation amplitude. Increasing the ink pressure or reducing the frequency, on the other hand, can increase the formation of satellite drops, which can reduce printhead reliability.

Thus there is a need for waveforms that provide a means to alter the size of the large drops relative to the small drops. The present invention addresses these needs.

SUMMARY OF THE INVENTION

The present invention is directed to overcoming one or more of the problems set forth above. Briefly summarized, according to one aspect of the invention, the invention resides in a method for operating a jetting module comprising providing a jetting module including a nozzle and a drop forming mechanism; providing a liquid to the jetting module under pressure sufficient to cause a liquid stream to jet from the nozzle; providing a small-drop waveform, the small-drop waveform having a starting endpoint and a trailing endpoint, the time between the starting endpoint and the trailing endpoint being the small-drop period $X_S$, the small-drop waveform including a small drop volume-control pulse, the small-drop volume-control pulse having a centroid, the centroid of the small-drop volume-control pulse being at a first defined time relative to a predefined one of the starting endpoint and the trailing endpoint of the small-drop waveform; providing a large-drop waveform, the large-drop waveform having a starting endpoint and a trailing endpoint, the time between the starting endpoint and the trailing endpoint being the large-drop period $X_L$, where $X_L=N*X_S$ and N is an integer greater than one, the large-drop waveform including a large-drop volume-control pulse, the large-drop volume-control pulse having centroid; wherein the centroid of the large-drop volume-control pulse being at a second defined time relative to the corresponding one of the starting endpoint and the trailing endpoint of the large-drop waveform, the second defined time being different from the first defined time; applying to the drop forming mechanism a sequence of drop formation waveforms in which a small-drop waveform applied after another identical small-drop waveform causes a small drop of volume Vs to be formed; applying a small-drop waveform after a large-drop waveform causes a small drop of volume Vs2 to be formed, where $V_{S2}$ is not equal to $V_S$; applying a large-drop waveform after another identical large-drop waveform causes a large drop of volume VL to be formed, where $V_L$~N*Vs; and applying a large-drop waveform after a small-drop waveform causes a large drop of volume VL2 to be formed, where $V_{L2}$ is not equal to $V_L$.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
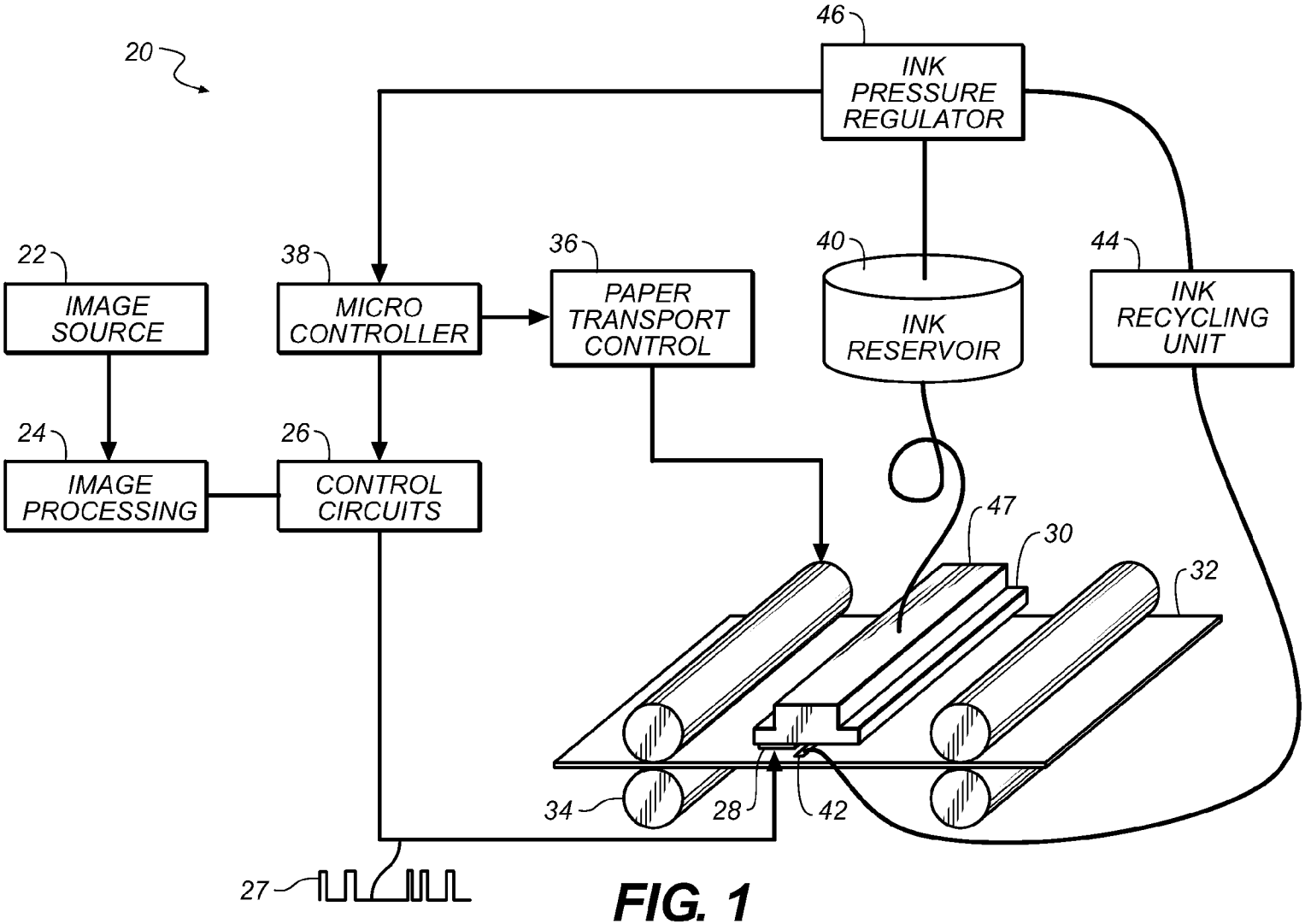
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described can take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Figure 2:
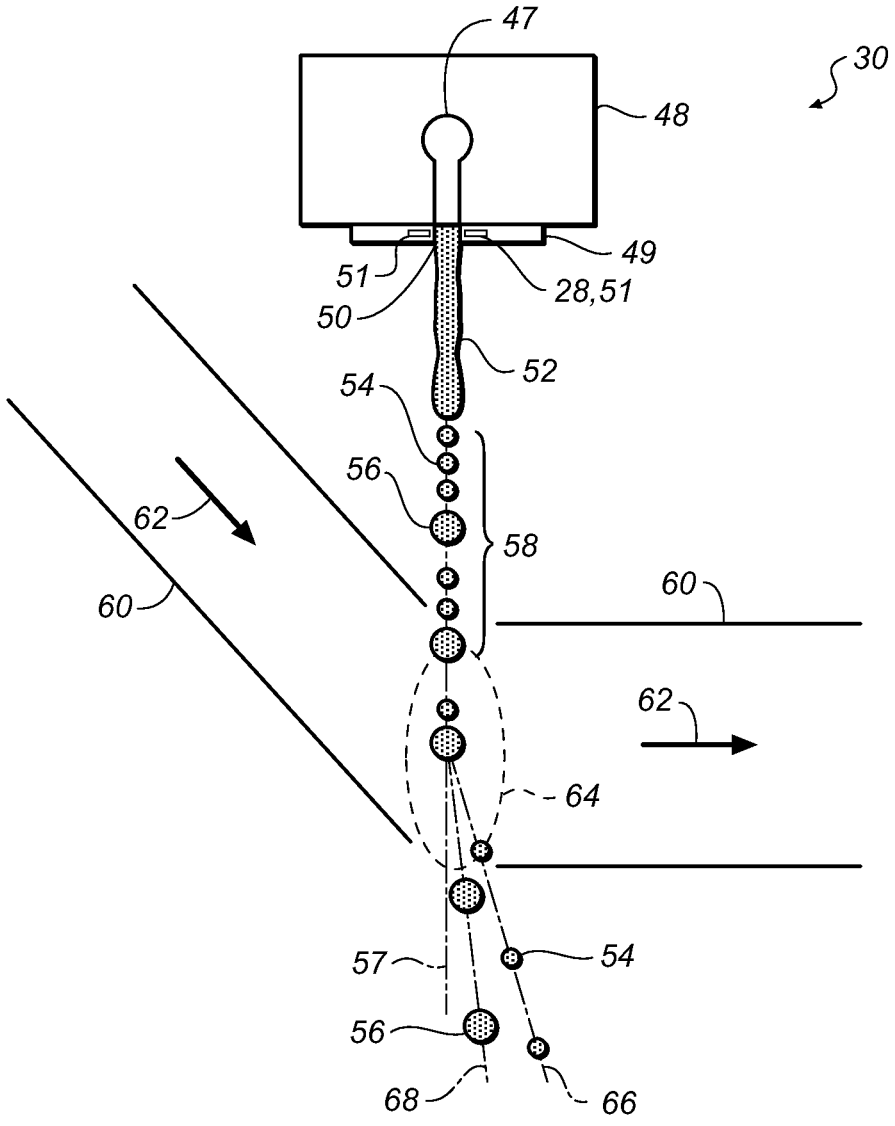
FIG. 2 is a schematic view of an example embodiment of a continuous printhead made in accordance with the present invention.
Figure 3:
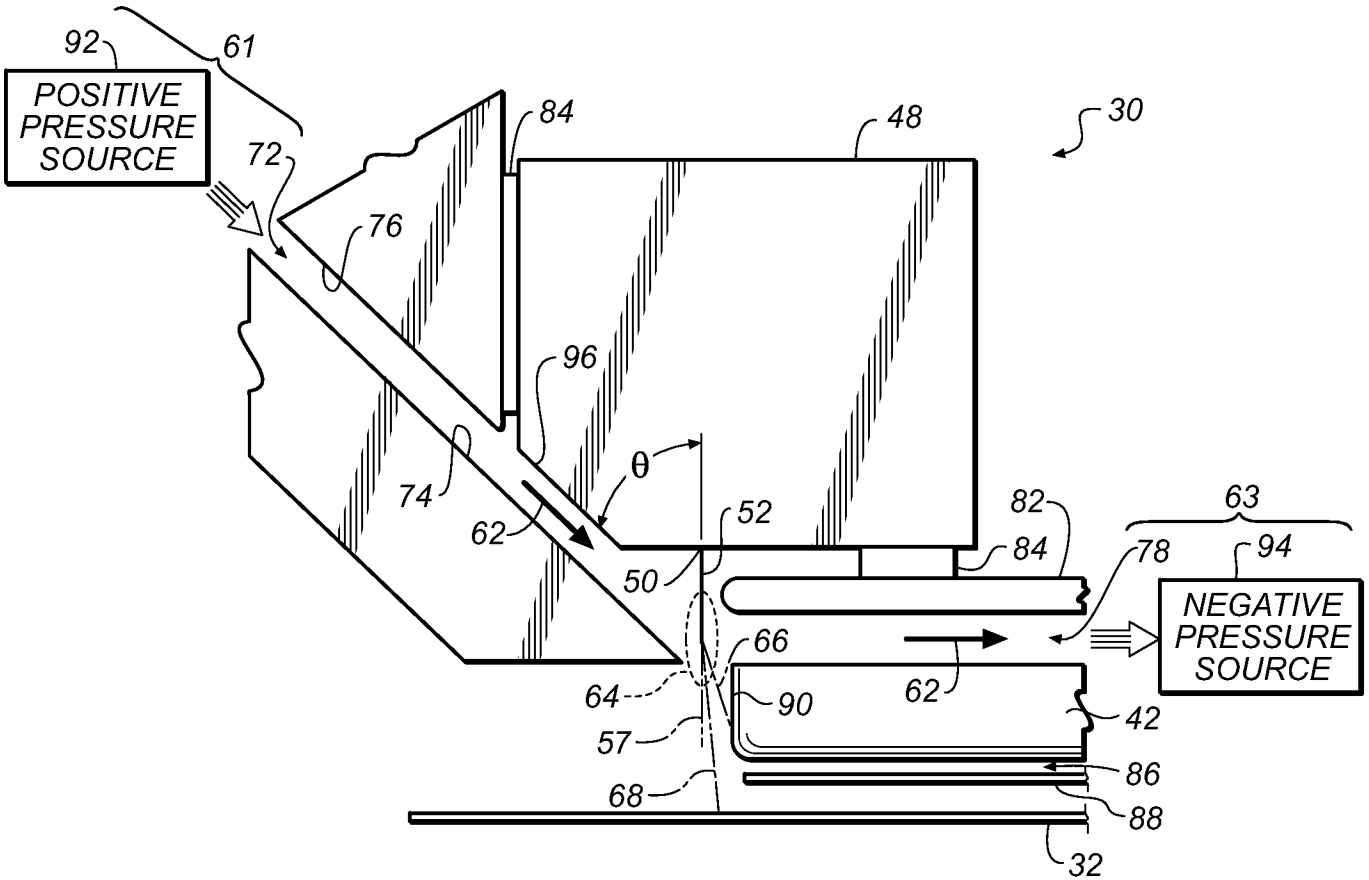
FIG. 3 is a schematic view of a simplified gas flow deflection mechanism of the present invention.

Referring to FIGS. 1, 2 and 3, example embodiments of a printing system and a continuous printhead are shown that include the present invention described below. It is contemplated that the present invention also finds application in other types of printheads or jetting modules including, for example, drop on demand printheads and other types of continuous printheads.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply drop formation waveforms 27, typically a sequence of time-varying electrical pulses, to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system 34 shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead 30. In the case of scanning print systems, it is usually most convenient to move the printhead 30 along one axis (the sub-scanning direction) and the recording medium 32 along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which can permit a portion of the ink to be recycled by an ink recycling unit 44. The ink recycling unit 44 reconditions the ink and feeds it back to reservoir 40. Such ink recycling units 44 are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir 40 can be left unpressurized, or even under a reduced pressure (vacuum), and a pump is employed to deliver ink from the ink reservoir 40 under pressure to the printhead 30. In such an embodiment, the ink pressure regulator 46 can include an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead 30. Printhead 30 also includes a deflection mechanism (not shown in FIG. 1) which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be an integral portion of the jetting module 48.

Liquid, for example, ink, is emitted under pressure through each nozzle 50 of the array to form filaments of liquid 52. In FIG. 2, the array or plurality of nozzles 50 extends into and out of the figure.

Jetting module 48 is operable to form liquid drops having a first size or volume and liquid drops having a second size or volume through each nozzle 50. To accomplish this, jetting module 48 includes a drop stimulation device 28, also commonly called a drop forming device, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in the nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

As discussed in these references, the volume of the drops formed by the activation of the drop forming device depends on the frequency or period of activation of the heater. A high frequency of activation of the drop forming device results in small-volume drops being formed and a low frequency of activations results in the formation of large-volume drops. When drop forming activation pulses are applied to the drop forming device, the drop forming devices perturb the liquid stream flowing past the drop forming device. The perturbation travels with the liquid of the liquid stream, to form a point where the jet pinches off to separate a newly formed drop from the rest of the jet. As the time interval between successive drop forming activation pulses increases, the length of the liquid stream between the resultant pinch points increases, yielding a drop of increased volume. Depending on the time intervals between activation pulses in this manner, large-volume drops and small-volume drops of any desired volume ratio can be created, ranging up to 10:1.

Figure 4:
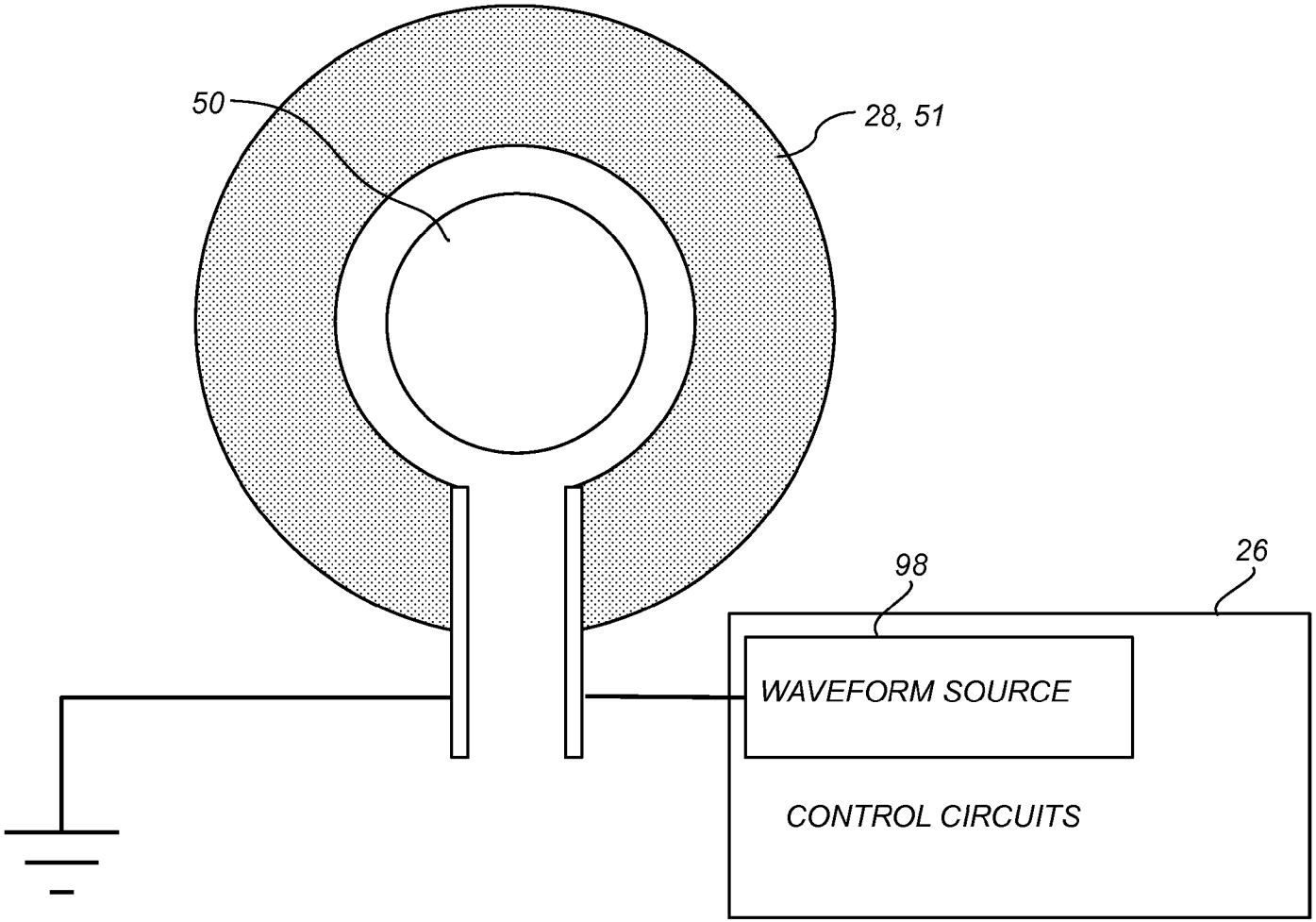
FIG. 4 is a drop forming device and control circuits associated with the nozzle.

Typically, one drop forming device 28 is associated with each nozzle 50 of the nozzle array. A drop forming device 28 can be associated with groups of nozzles 50 or all of nozzles 50 of the nozzle array. FIG. 4 is a plan view of a portion of the nozzle plate 49 showing the nozzle 50 with an associated drop formation device 28, according to one embodiment of the invention. The drop forming device 28 is a single drop forming transducer that substantially surrounds the nozzle. The drop forming transducer can be one of a heater, piezoelectric transducer, electrohydrodynamic stimulation device, thermal actuator or any other drop forming transducer. In response to a drop forming waveform supplied to the drop forming transducer, it acts on one of the nozzles 50, the liquid passing through the nozzle 50, or the liquid jet flowing from the nozzle 50 to introduce a perturbation to the liquid jet such that the perturbation can grow to cause a drop 54, 56 to break off from the liquid jet. The drop forming transducer substantially surrounds the nozzle 50 so that as it acts on the liquid passing through the nozzle 50 and it doesn't substantially alter the directionality of the liquid jet.

When printhead 30 is in operation, drops 54, 56 are typically created in a plurality of sizes or volumes, for example, in the form of large drops 56, a first size or volume, and small drops 54, a second size or volume from each of the nozzles 50 in the nozzle array. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory 57 is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. When the volume ratio between the large-volume drops 56 and the small-volume drops 54 is greater than 2:1, the flow of gas 62 provides sufficient drop deflection and therefore sufficient divergence of the small and large drop trajectories 66, 68 so that catcher 42 (shown in FIGS. 1 and 3) can be positioned to intercept one of the small drop trajectory 66 and the large drop trajectory 68 so that drops 54, 56 following the drop trajectory 66, 68 are collected by catcher 42 while drops 54, 56 following the other drop trajectory 66, 68 bypass the catcher and impinge the recording medium 32 (shown in FIGS. 1 and 3).

When catcher 42 is positioned to intercept large drop trajectory 68, small drops 54 are deflected sufficiently to avoid contact with catcher 42 and strike the print media. As the small drops 54 are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation device 28, also called a drop forming device or drop forming mechanism, (shown in FIGS. 1 and 2) associated with jetting module 48 is selectively actuated to perturb the filament of liquid 52 to induce portions of the filament to break off from the filament to form drops. The selective activation of the drop forming device 28 occurs in response to drop formation waveforms 27 received from a waveform source 98, which is a portion of the control circuits 26. The waveform source typically creates a sequence of drop formation waveforms 27 based on the dot pattern to be printed. Each waveform has a starting endpoint and a trailing endpoint. The time between the starting endpoint of a waveform and the trailing endpoint of the waveform is equal to the period of the waveform. In the sequences of waveforms, the trailing endpoint of a waveform is coincident with the starting endpoint of the subsequent waveform; therefore a single reference number 130 will be used as reference for both the starting endpoints and the trailing endpoints throughout the application. Each waveform has period or time duration. The sequence of waveforms from the waveform source consists of one or more waveforms for the creation of small drops, called small-drop waveforms, and one or more waveforms for the creation of large drops, called large-drop waveforms. Each of the one or more small-drop waveforms and each of the one or more large-drop waveforms include a drop forming pulse. The drop forming pulse of each waveform, when applied to the drop forming device 28, creates a perturbation of the filament of liquid 52. The perturbation created by the drop forming pulse grows becoming a pinch point at which the liquid filament breaks, separating a liquid drop from the rest of the filament. The drop forming pulse of a waveform controls the break-up point and drop formation boundary between the drop formed by the waveform and the drop to be formed by the next drop forming waveform. The time interval between the drop forming pulses controls the spacing along the filament between the pinch points, and thereby controls the volume of the created drop, the large drop volume control pulse controls the jet break-up point and drop formation boundary between the large-drop and it's adjacent small or large drop The drop forming pulses are also called volume-control pulses. As discussed in U.S. Pat. No. 7,828,420, a drop formation waveform 27 can include one or more additional pulses in addition to the drop forming pulse. These one or more additional pulses don't create drop breakoff pinch points but they can influence the drop formation length and other characteristics of the drop formation process. A sequence of drops is created in the form of large drops and small drops that travel toward the recording medium 32 according to the supplied sequence of large drop and small-drop waveforms.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure 63 includes a second gas flow duct 78 located between catcher 42 and an upper wall 82 that exhausts gas flow 62 from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism 28 in addition to the deflection mechanism. This type of drop formation and deflection is known having been described in, for example, U.S. Pat. No. 6,079,821, issued to Chwalek et al., on Jun. 27, 2000.

Deflection can also be accomplished using an electrostatic deflection mechanism. The electrostatic deflection mechanism can facilitate drop charging and drop deflection using a single electrode per jet, like the one described in U.S. Pat. No. 4,636,808, or through the use of separate drop charging and drop deflection electrodes. Typically an individual drop charging electrode is associated with each jet, as described in U.S. Pat. No. 4,636,808. Alternative electrostatic deflection mechanisms use a single drop charging electrode for an array of nozzles, as described in U.S. Pat. No. 7,938,516 or U.S. Published Application No. 20100033542.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and either can be used usually the selection depending on the application contemplated. Alternatively, catcher 42 can be of any suitable design including, but not limited to, a porous face catcher, a delimited edge catcher, or combinations of any of those described above.

In typical printheads, the jetting module 48 contains a large number of nozzles 50, each with an associated drop forming device 28. Each drop forming device 28 receives sequences of drop formation waveforms 27 from a corresponding waveform source 98. The drop formation waveforms 27 typically are waveforms of the voltage applied to the drop forming device 28. Alternatively the drop formation waveforms 27 can be waveforms of the current applied to the drop forming device 28. While the drop forming device can be actuated to form large drops and small drops of any desired volume ratio up to 10:1, including both integer and non-integer ratios, the mechanism control circuits 26 containing the waveform sources 98 for the array of drop forming devices 28 become unacceptably complex if the periods of the one or more large-drop waveforms are not all equal to each other. Similarly, the periods of the one or more small-drop waveforms should also be equal to each other to avoid inacceptable control circuit complexity. Furthermore to avoid unacceptable complexity in the control circuits, the period of the large-drop waveforms should be equal to the period of the small-drop waveforms times an integer N; $2 \leq N \leq 10$. In prior art systems having arrays of nozzles and independent drop selection per nozzle, these limitations on the periods of the large-drop waveforms and the small-drop waveforms have restricted the volume ratio of large-volume drops to small-volume drops to integer values.

The present invention overcomes this limitation of the art by providing a jetting module 48 including a nozzle 50 and a drop forming mechanism 28; providing a liquid to the jetting module 48 under pressure sufficient to cause a liquid stream to jet from the nozzle 50; providing a small-drop waveform, the small drop waveform having a starting endpoint and a trailing endpoint, the small-drop waveform having a small-drop period $X_S$, the small-drop waveform including a small drop volume-control pulse, the small-drop volume-control pulse of the small-drop volume-control pulse having centroid, the centroid of the small-drop volume-control pulse being at a first defined time relative a predefined one of the starting endpoint and the trailing endpoint of the small-drop waveform; providing a large-drop waveform, the large-drop waveform having a starting endpoint and a trailing endpoint, the large-drop waveform having a large-drop period $X_L$, where $X_L=N*X_S$ and N is an integer greater than one, the large-drop waveform including a large-drop volume-control pulse, the large-drop volume-control pulse having centroid; wherein the centroid of the large-drop volume-control pulse being at a second defined time relative to the corresponding one of the starting endpoint and the trailing endpoint, the second defined time being different from the first defined time; applying to the drop forming mechanism a sequence of drop formation waveforms in which a small-drop waveform applied after another identical small-drop waveform causes a small drop of volume Vs to be formed; applying a small-drop waveform after a large-drop waveform causes a small drop of volume Vs2 to be formed, where $V_{S2}$ is not equal to $V_S$; applying a large-drop waveform after another identical large-drop waveform causes a large drop of volume VL to be formed, where $V_L$~N*Vs; and applying a large-drop waveform after a small-drop waveform causes a large drop of volume VL2 to be formed, where $V_{L2}$ is not equal to $V_L$.

Figure 5:
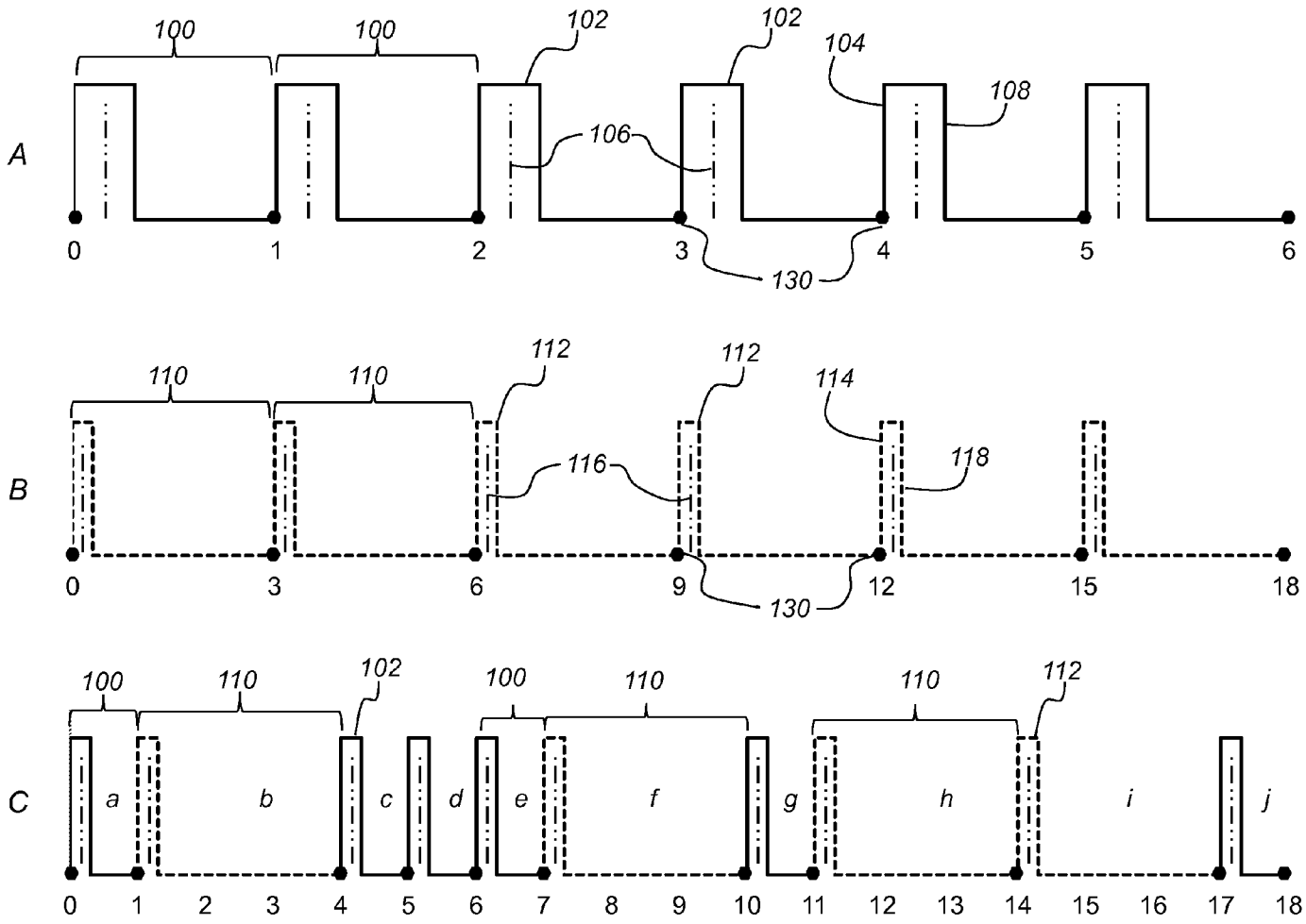
FIG. 5 (Prior Art)
FIGS. 5*a-c* are prior art waveforms for creating large and small drops.

To enable the invention to be better understood, prior art waveforms for the formation of large drops 56 and small drops 54 will first be described, and then waveforms for several embodiments of the invention will be described. FIGS. 5A-5C show sequences of prior art waveforms. FIG. 5A shows a sequence of small-drop waveforms 100. Each of the small-drop waveforms 100 has a period of 1 $X_S$. (The units of the waveform times scale in this and subsequent waveform figures are in small-drop periods $X_S$.) The individual small-drop waveforms 100 each include a drop forming pulse 102, also called a volume controlling pulse. Each drop-forming pulse 102 has a leading edge 104, a trailing edge 108 and a centroid 106. The leading edge 104 of the drop forming pulse 102 is at the starting endpoint 130 of the small-drop waveform 100. As the time from one volume-control pulse 102 to the next is constant, equal to $X_S$, the application of this sequence of waveforms to the drop forming device 28 causes a sequence of small drops 54 to be formed; each with the same volume. The volume of these small drops 54 is defined to be Vs.

FIG. 5B shows a sequence of large-drop waveforms 110. Each of the large-drop waveforms 110 includes the drop forming pulse 102, and has a period of $X_L$ that is equal to $3X_S$. Each volume-control pulse 112 has a leading edge 114, a trailing edge 118 and a centroid 116. The leading edge 104 of the drop forming pulse 102 is at the starting endpoint 130 of the large-drop waveform 100. The time between successive drop forming pulses 102 is $X_L=3X_S$, three times the time between the drop forming pulses 102 of FIG. 5A. As the time between successive drop forming pulses 102 is three times the time between the drop forming pulses 102 of FIG. 5A, the distance on the liquid jet between the pinch points created by the drop forming pulses 102 of the sequence of large-drop waveforms 110 is three times the distance on the liquid jet between the pinch points created by the drop forming pulses 102 of the sequence of small-drop waveforms 100. As a result, the drops 56 formed by the application of the sequence of large-drop waveforms 110 have volumes, $V_L$, which are three times the volume of the drops 54 formed by the application of the small-drop waveforms 100; that is, $V_L$=3 Vs.

FIG. 5C shows an sequence of waveforms that includes both small-drop waveforms 100 and large-drop waveforms 110. The small-drop waveforms 100 are same as the small-drop waveforms 100 of FIG. 5A, and the large-drop waveforms 110 are the same as that of FIG. 5B. The waveforms 100, 110 in the sequence have been individually labeled a-i. The drop forming pulses 102, 112 of these waveforms 100, 110 each have their leading edges at the starting endpoint 130 of the waveform 100, 110. The large drops waveforms 110, labeled b, f, h, and i, each have periods $X_L=3X_S$, while small-drop waveforms 100, labeled a, c, d, e, and g, each have periods of $X_S$. The time interval between the drop forming pulse 112 of waveform b and the drop forming pulse 102, 112 of the following waveform, waveform c, is equal to $X_L$; this is three times the time interval between the drop forming pulse 102 of waveform a and the drop forming pulse 112 of waveform b. As a result, waveform b produces a large drop 56 having a volume $V_L$ which is three times the volume Vs of the small drop 54 produced by waveform a. In a similar manner, waveforms f, h, and i produce large drops 56 having volumes $V_L$ that are three times the volume Vs of the small drops 54 produced by waveforms c, d, e, and g.

Figure 6:
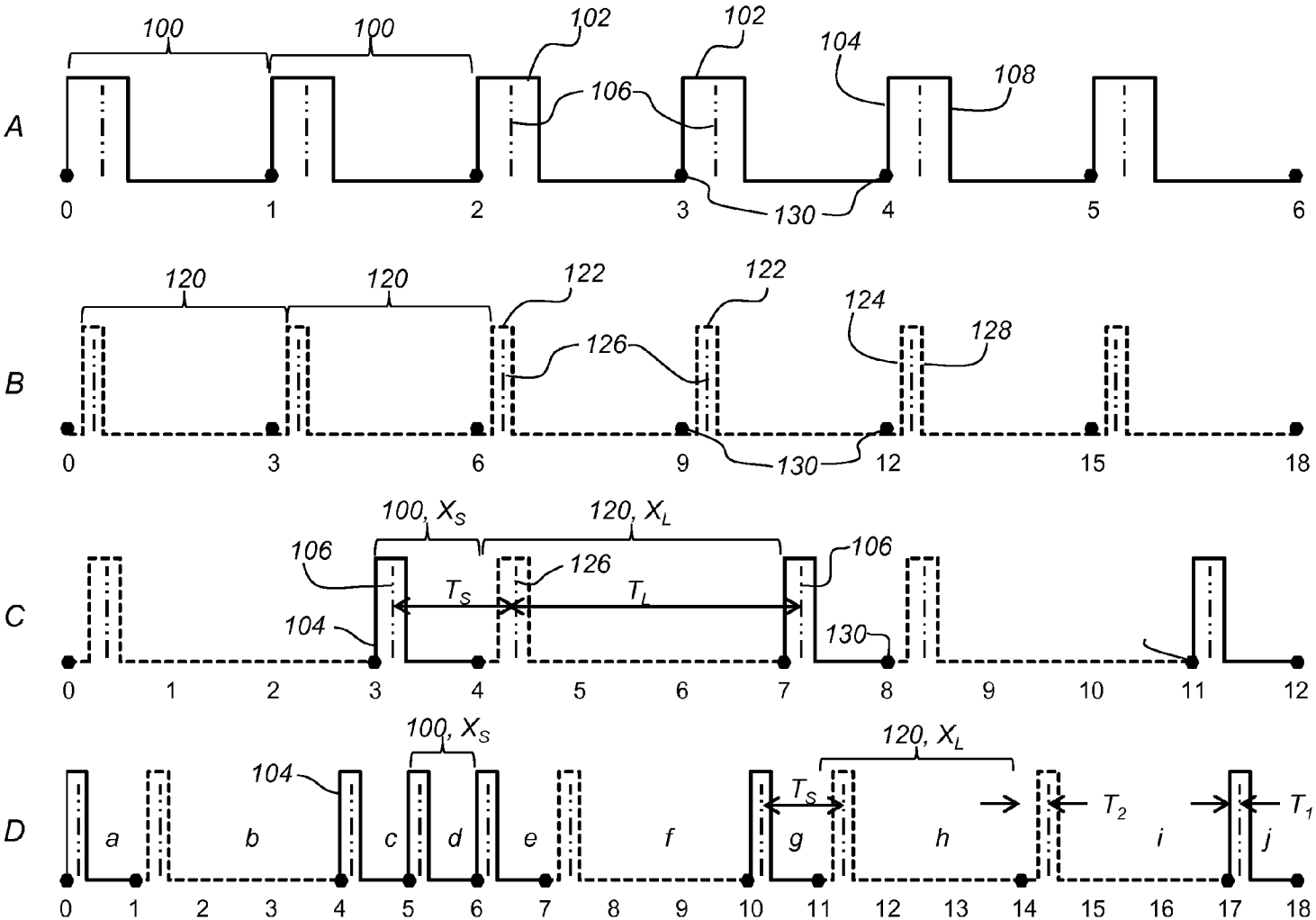
FIGS. 6*a-d* are waveforms of the present invention for creating large and small drops.

FIG. 6 shows sequences of waveforms according to an embodiment of the invention. FIG. 6A shows a sequence of small-drop waveforms 100. In this embodiment, small-drop waveforms 100 are unchanged from those of the prior art shown in FIG. 5A. The small-drop waveforms 100 have the same period Xs and same duty cycle as those of FIG. 5A. Furthermore the leading edge 104 of the drop forming pulse 102 is located at the start or starting endpoint, of each small-drop waveform 100 as was the case in FIG. 5A. The small drops created by the sequence of small-drop waveforms 100 in FIG. 6A will therefore have the same volume as small drops 54 produced by the small-drop waveforms 100 of FIG. 5A; the small drop volume will be Vs.

FIG. 6B shows a sequence of large-drop waveforms 120. These large-drop waveforms 120 have the same period $X_L$ as the large-drop waveforms 110 of FIG. 5B. The duty cycle and amplitude of the drop forming pulses 122 are also unchanged from that of FIG. 5B. Each drop-forming pulse 122 has a leading edge 124, a trailing edge 128 and a centroid 126. The large-drop waveforms 120 differ from the large-drop waveforms 110 of FIG. 5B. The drop forming pulse 122 has been shifted, delayed within the large-drop waveform 120 so that the leading edge 124 of the drop forming pulse 122 is no longer at the starting endpoint 130 of the large-drop waveform 120. The center or centroid 126 of the drop forming pulse 122 of the large-drop waveform 120 has been delayed or shifted relative to the start, or starting endpoint 130, of the large-drop waveform 120 when compared to the centroid 106 of the drop forming pulse 102 of small-drop waveform 100 of FIG. 6A. As each of the drop forming pulses 120 has been delay by the same amount relative to the starting endpoint 130 of the associated large-drop waveform 120, the time interval between the drop forming pulses 122 is equal to the period $X_L$ of the large-drop waveform 120. As a result, the volume of the large drops created by the application of this sequence of large-drop waveforms 120 is equal to the volume of the large drops created by the application of the large-drop waveforms 110 of FIG. 5B; the volume of the large drops produced by the sequence of large drops waveform 120 of FIG. 6B is equal to $V_L$ which is equal to 3 times the volume $V_S$ of the small drops produced by the sequence of small-drop waveforms 100 of FIG. 6A.

Figure 7:
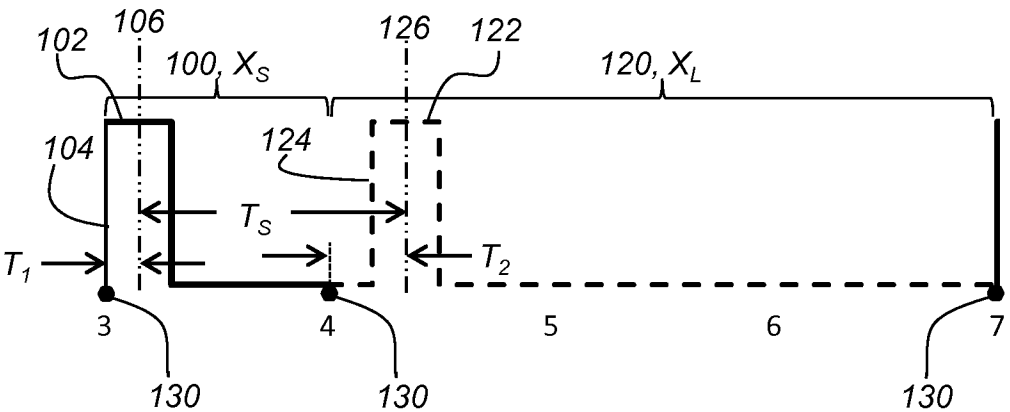
FIG. 7 is an enlarged view of a portion of FIG. 6*c;*

FIG. 6C shows an alternating sequence of small-drop waveforms 100 and large-drop waveforms 120; the small-drop waveforms 100 being of the type shown in FIG. 6A and the large-drop waveforms 120 being of the type shown in FIG. 6B. See also FIG. 7, which is a close up view of a single small-drop waveform 100 and single large-drop waveform 120 from the sequence in FIG. 6C. The small-drop waveforms 100 each have the leading edge 104 of the drop forming pulse 102 at the starting endpoint 130 of the small-drop waveform 100. The centroid 106 of the drop forming pulse 102 is at a first predetermined time $T_1$ relative to the starting endpoint 130 of the small-drop waveform 100. The location or timing of the drop forming pulse 122 within the large-drop waveform 120 has been shifted, delayed, so that the leading edge 124 of the drop forming pulse 122 is not at the starting endpoint of the large-drop waveform 120. Due to this shifting of the drop forming pulse 122 timing, the centroid 126 of the drop forming pulse 122 of the large-drop waveform 120 is at a second predetermined time $T_2$ relative to the starting endpoint 130 of the large-drop waveform 120; the second predetermined time being different from the first predetermined time. The time interval $T_S$ between the centroid 106 of the drop forming pulse 102 of the small-drop waveform 100 and the centroid 126 of the drop forming pulse 122 of the following large-drop waveform 120 is not equal to the small-drop period $X_S$, but rather is larger than that by an amount equal to $T_2-T_1$. As a result of this increased time between these drop forming pulses 102, 122, the small drop that is created has a volume $V_{S2}$ that is larger than volume $V_S$ of the small drop created by consecutive small-drop pulses in FIG. 6A. On the other hand, the time interval $T_L$ between the centroid 126 of the drop forming pulse 122 of the large-drop waveform 120 and the centroid 106 of the drop forming pulse 102 of the following small-drop waveform 100 is less than $X_L$ by an amount equal to $T_2-T_1$. The large drop that is produced has a volume $V_{L2}$ that is less than the volume $V_L$ of large drops produced by consecutive large drops waveforms 120 as in FIG. 6B. By varying the amount by which the timing of the volume-control pulse of the large-drop waveform 120 is shifted, which varies the difference $T_2-T_1$, the volume difference between $V_{L2}$ and $V_L$ and the volume difference between $V_{S2}$ and $V_S$ can be varied.

FIG. 6D shows a sequence of waveforms that both small-drop waveforms 100 and large-drop waveforms 120. The individual waveforms 100, 120 have been labeled *a-i* to aid in the description. The small-drop waveforms 100 each have the leading edge 104 of the drop forming pulse 102 at the starting endpoint 130 of the small-drop waveform 100. The centroid 106 of the drop forming pulse 102 is at a first predetermined time $T_1$ relative to the starting endpoint 130 of the small-drop waveform 100. The location or timing of the drop forming pulse 122 within the large-drop waveform 120 has been shifted, delayed, so that the leading edge 124 of the drop forming pulse 122 is not at the starting endpoint 130 of the large-drop waveform 120. Due to this shifting of the drop forming pulse 122 timing, the centroid 126 of the drop forming pulse 122 of the large-drop waveform 120 is at a second predetermined time $T_2$ relative to the starting endpoint 130 of the large-drop waveform 120; the second predetermined time being different from the first predetermined time. Just like the small-drop waveforms 100 of FIG. 6C were followed immediately thereafter by a large-drop waveform 120, the small-drop waveforms 100 labeled *a, e*, and *g* are each are followed immediately thereafter by a large-drop waveform 120. The time interval between the centroid 106 of the drop forming pulse 102 of the small-drop waveform 100 for each of these small-drop waveforms 100, a, e, and g, and the centroid 126 of the drop forming pulse 122 of the following large-drop waveform 120 is not equal to the small-drop period $X_S$, but rather is larger than that by an amount equal to $T_2-T_1$. As a result, the volume of the small drop that is created is not equal to $V_S$ but rather is equal to $V_{S2}$; where $V_{S2}>V_S$. Just as the large-drop waveforms 120 of FIG. 6C were followed immediately thereafter by a small-drop waveform 100, the large-drop waveforms 120 b, f, and i are followed immediately thereafter by small-drop waveforms 100 c, g, and j. The time interval between the centroid 126 of the drop forming pulse 122 of a large-drop waveform 120 for each of these large-drop waveforms 120, b, f, and i, and the centroid 106 of the drop forming pulse 102 of the following small-drop waveform 100 is less than $X_L$ by an amount equal to $T_2-T_1$. The large drop that is produced has a volume $V_{L2}$, like those produced by the large-drop waveforms 120 in FIG. 6C. This volume is less than volume $V_L$ of large drops produced by consecutive large drops waveforms 120 as in FIG. 6B. Small-drop waveform 100*b* immediately precedes small-drop waveform 100*d*, and small-drop waveform 100 immediately precedes small-drop waveform 100*e*. The time interval between the drop forming pulse 102 of small-drop waveform 100*c* and the drop forming pulse 102 of small-drop waveform 100*d* is equal to the $X_S$, as is the time between the drop forming pulse 102 of small-drop waveform 100*d* and the drop forming pulse 102 of small-drop waveform 100*e*. As this time interval equals that between the drop forming pulses 102 of the small-drop waveforms 100 in FIG. 6A, the volume of the drops created by these time intervals between drop forming pulses 102 is equal to $V_S$. Large-drop waveform 120 *h* immediately precedes large-drop waveform i. The time interval between the drop forming pulses 122 of these two large-drop waveforms 120 is equal to $X_L$, where $X_L=3X_S$. The resulting drop therefore as a volume VL, where $V_L=3V_S$.

For this embodiment, delaying the drop forming pulse 122 within the large-drop waveform 120 caused the centroid 126 of the drop forming pulse 122 to be at a time interval $T_2$ relative to the starting endpoint 130 of the large-drop waveform 120. This time interval is different from the time interval $T_1$ between the centroid 106 of the drop forming pulse 102 of the small-drop waveform 100 and the starting endpoint 130 of the small-drop waveform 100. When consecutive small-drop waveforms 100 are applied to the drop forming mechanism 28, a small drop of volume $V_S$ is formed. When consecutive large-drop waveforms 120 are applied to the drop forming mechanism 28, a large drop of volume VL is formed, where $V_L=3V_S$. Applying a large-drop waveform 120 immediately after a small-drop waveform 100 causes a small drop to be formed having a volume $V_{S2}$, which is different from $V_S$. Applying a small-drop waveform 100 immediately after a large-drop waveform 120 produces a large drop having a volume $V_{L2}$, which is different from $V_L$. In this embodiment, the volume $V_{S2}$ is larger than $V_S$, and the volume $V_{L2}$ is less than $V_L$.

Figure 8:
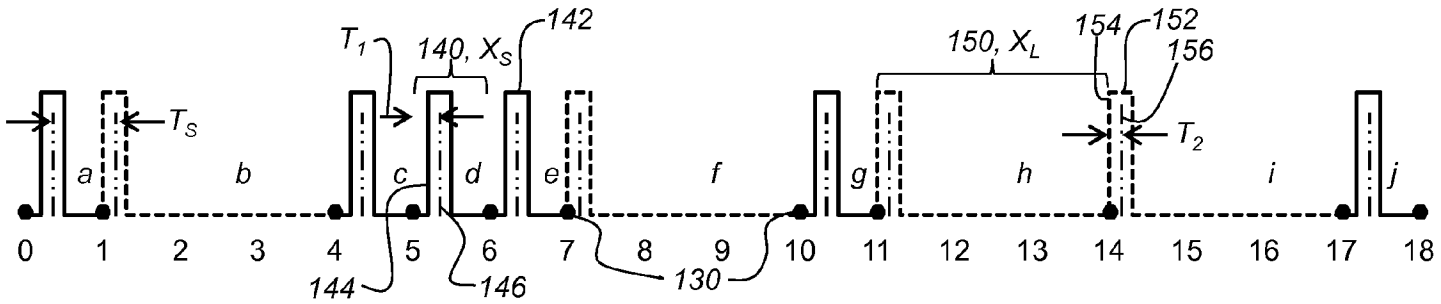
FIG. 8 is a waveform of the present invention for creating large and small drops according to other embodiments of the present invention.

In the embodiment described above, the timing of the drop forming pulse 122 of the large-drop waveform 120 was shifted so that the leading edge of the drop forming pulse 122 was not at the starting endpoint 130 of the large-drop waveform 120, while the leading edge of the drop forming pulse 102 of the small-drop waveform 100 was at the starting endpoint 130 of the small-drop waveform 100. As described above, this reduced the volume of a large drop created by a large-drop waveform 120 followed by a small-drop waveform 100; $V_{L2}<V_L$, and increased the volume of a small drop created by a small-drop waveform 100 followed by a large-drop waveform 120; $V_{S2}>V_S$. In an alternate embodiment shown in FIG. 8, the drop forming pulse 142 of the small-drop waveform 140 is delayed instead of the drop forming pulse 152 of the large-drop waveform 150. The leading edge 144 of the drop forming pulse 142 of the small-drop waveform 140 is not at the starting endpoint 130 of the small-drop waveform 140, but the leading edge 154 of the drop forming pulse 152 of the large-drop waveform 150 is at the starting endpoint 130 of the large-drop waveform 150. The centroid 146 of the drop forming pulse 142 of the small-drop waveform 140 is at a first time interval $T_1$ relative to the starting edge 130 of the small-drop waveform 140. The centroid 156 of the drop forming pulse 152 of the large-drop waveform 150 is at a second time interval $T_2$ relative to the starting edge 130 of the large-drop waveform 150. The second time interval $T_2$ is different from the first time interval $T_1$. In this embodiment, the first time interval $T_1$ is greater than the second time interval $T_2$. When consecutive small-drop waveforms 140 are applied to the drop forming mechanism 28, a small drop of volume $V_S$ is formed. When consecutive large-drop waveforms 150 are applied to the drop forming mechanism 28 a large drop of volume $V_L$ is formed, where $V_L=3V_S$. When a large-drop waveform 150 is applied immediately after a small-drop waveform 140, the time interval $T_S$ between the centroid 146 of the drop forming pulse 142 of the small-drop waveform 140 and the centroid 156 of the drop forming pulse 152 of the following large-drop waveform 150 is not equal to the small-drop period $X_S$; $T_S<X_S$. As a result, the small drop that is formed has a volume $V_{S2}$, which is different from $V_S$. Similarly applying a small-drop waveform 140 immediately after a large-drop waveform 150 produces a large drop having a volume $V_{L2}$, which is different from $V_L$. In this embodiment, the volume $V_{S2}$ is smaller than $V_S$, and the volume $V_{L2}$ is greater than $V_L$.

Figure 9:
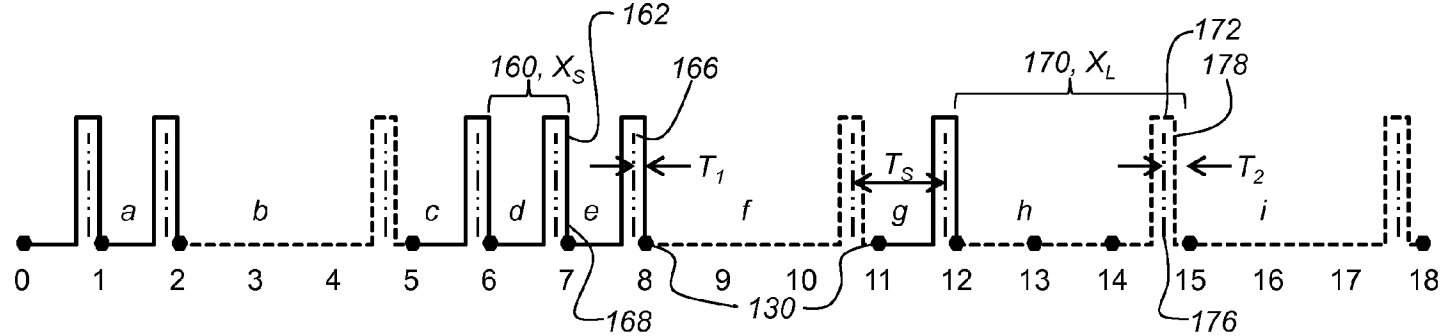
FIG. 9 is a waveform of the present invention for creating large and small drops according to another embodiment of the present invention.

In the embodiments of the invention described above, the leading edge of drop forming pulse or volume-control pulse of either the small-drop waveform or the large-drop waveform was at the starting endpoint of the waveform, while the volume-control pulse of the other of the small-drop waveform or the large-drop waveform was delayed so that the leading edge of the delayed volume-control pulse was not at the starting endpoint of the corresponding waveform. The centroid of the drop forming pulse of the small-drop waveform is at a first time interval $T_1$ relative to the starting edge of the small-drop waveform. The centroid of the drop forming pulse of the large-drop waveform is at a second time interval $T_2$ relative to the starting edge of the large-drop waveform. The second time interval $T_2$ is different from the first time interval $T_1$. FIG. 9 shows another embodiment, in which the trailing edge 168 or 178 of the volume-control pulse of either the small-drop waveform 160 or the large-drop waveform 170, respectively, was at the trailing endpoint 130 of the waveform 160, 170, while the drop forming pulse 162, 172 of the other of the small-drop waveform 160 or the large-drop waveform 170 was advanced so that the trailing edge 168, 178 of the advanced drop forming pulse 162, 172 was not at the trailing endpoint 130 of the corresponding waveform 160, 170. In this embodiment, the centroid 166 of the drop forming pulse 162 of the small-drop waveform 160 is at a first time interval $T_1$ measured relative to the trailing endpoint 130 rather than the starting endpoint 130 of the small-drop waveform 160. In this example, the trailing endpoint is in the predetermined endpoint. The centroid 176 of the drop forming pulse 172 of the large-drop waveform 170 is at a second time interval $T_2$ relative to the trailing endpoint 130 of the large-drop waveform 170. The second time interval $T_2$ is different from, larger than, the first time interval $T_1$. In this embodiment, the timing of the drop-forming pulse 172 of the large-drop waveform 170 and of drop-forming pulse 162 of the small-drop waveform 160 are both measured from the trailing point 130 of the respective waveforms. The trailing endpoint 130 of the small-drop waveform 160 in this embodiment serves as a predefined endpoint from which to measure the timing of the pulse. The timing of the pulse of the large-drop waveform 170 is measured from the corresponding endpoint 130 to the predefined endpoint 130 of the small-drop waveform 160, in that the timing of the drop-forming pulse 172 of the large-drop waveform 170 is also measured from the trailing endpoint 130. If the predefined endpoint of the small-drop waveform 160 is the trailing endpoint 130 of the small-drop waveform 160 the corresponding endpoint of the large-drop waveform 170 is also the trailing endpoint 130 of the large-drop waveform 170. On the other hand, as was done in the embodiment of FIG. 8, where the predefined endpoint 130 of the small-drop waveform 140 from which to time the drop-forming pulse 142 of the small-drop waveform 140 is the starting endpoint of the small-drop waveform 140, then the corresponding endpoint of the large-drop waveform 150 is the starting endpoint of the large-drop waveform 150 relative to which the timing of the drop-forming pulse 152 of the large-drop waveform 150 is measured. Returning to the embodiment of FIG. 9, the trailing endpoint 130 of the large drop waveform 170 corresponds to the trailing endpoint 130 of the small drop waveform 160. When a large-drop waveform 170 is applied immediately after a small-drop waveform 160 as in large-drop waveform 170*b*, the time interval $T_L$ between the centroid 166 of the drop forming pulse 162 of the small-drop waveform 160 and the centroid 176 of the drop forming pulse 172 of the following large-drop waveform 170 is not equal to the small-drop period $X_L$. As a result, the large drop that formed has a volume $V_{L2}$, which is different from $V_L$. Similarly applying a small-drop waveform 160 immediately after a large-drop waveform 170 produces a small drop having a volume $V_{S2}$, this is different from $V_S$. In this embodiment, the volume $V_{S2}$ is greater than $V_S$, and the volume $V_{L2}$ is less than $V_L$. This embodiment like the previous ones enables drops to be created with drop volumes $V_S$, $V_{S2}$, $V_L$, and $V_{L2}$, where $V_L=3*V_S$, $V_{S2}$ is different from $V_S$, and $V_{L2}$ is different from $V_L$.

Figure 10:
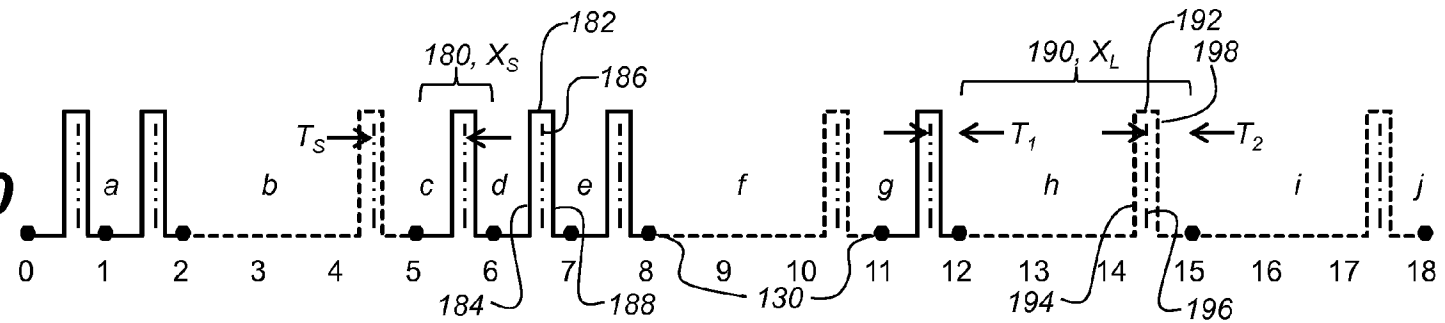
FIG. 10 is a waveform of the present invention for creating large and small drops according to a final embodiment of the present invention.

FIG. 10 shows another embodiment of the invention. This embodiment has a set of waveforms in which the small-drop waveform 180 or the large-drop waveform 190 have the leading edges 184 and 194 and the trailing edges 188 and 198 of the drop-forming pulses 182 and 192, respectively are located away from both the starting endpoint and the trailing endpoint of the corresponding waveform 180, 190. In this embodiment, the centroid 186 of the drop forming pulse 182 of the small-drop waveform 180 is at a first time interval $T_1$ relative to the one of the endpoints of the small-drop waveform 180 and the centroid 186 of the drop forming pulse 192 of the large-drop waveform 190 is at a second time interval $T_2$ relative to the corresponding endpoint of the large-drop waveform 190; and where the second time interval $T_2$ is different from the first time interval $T_1$. When a large-drop waveform 190 is applied immediately after a small-drop waveform 180 as in large-drop waveform 190 *b*, the time interval $T_L$ between the centroid 186 of the drop forming pulse 182 of the small-drop waveform 180 and the centroid 196 of the drop forming pulse 192 of the following large-drop waveform 190 is not equal to the small-drop period $X_L$. As a result, the large drop that formed has a volume $V_{L2}$, which is different from $V_L$. Similarly, applying a small-drop waveform 180 immediately after a large-drop waveform 190, as in small-drop waveform 180 *c*, produces a small drop having a volume $V_{S2}$, which is different from $V_S$. In this embodiment, the volume $V_{S2}$ is greater than $V_S$, and the volume $V_{L2}$ is less than $V_L$. This embodiment like the previous ones enables drops to be created with drop volumes $V_S$, $V_{S2}$, $V_L$, and $V_{L2}$, where $V_L=3*V_S$, $V_{S2}$ is different from $V_S$, and $V_{L2}$ is different from $V_L$.

In each of these embodiments, varying the amount by which the timing of the drop-forming pulse of the small-drop waveform and/or of the large-drop waveform is shifted varies the difference $T_2-T_1$, the volume difference between $V_{L2}$ and $V_L$ and the volume difference between $V_{S1}$ and $V_S$ can be varied. By appropriate selection of the timing of the drop-forming pulses, the volume difference between the small drop $V_{S2}$ and small drop volume $V_S$, $|V_{S2}-V_S|$ can be selected to be greater than of $0.03*V_S$, or greater than $0.05*V_S$, or greater than and $0.1*V_S$. It tends not to be practical to adjust the drop-forming pulse timings to produce a volume difference between the small drop $V_{S2}$ and small drop volume $V_S$, $|V_{S2}-V_S|$, of greater than $0.3*V_S$.

The embodiments described above have a large-drop waveform with a period of $X_L$ which is equal to three times the period $X_S$ of the small-drop waveform. When consecutive large-drop waveforms are applied, the resulting large drop has a volume $V_L=3*V_S$. The invention is not limited to a factor of three in waveform periods between the large-drop waveforms and the small-drop waveforms. In general, the ratio between the large-drop waveform period and the small-drop waveform period can be any integer value. The ratio in the periods will be denoted by N. In the more generalized form, the consecutive small-drop waveforms produce small drops of volume $V_S$, and consecutive large-drop waveforms produce large drops of volume $V_L$, where $V_L=N*V_S$. Applying a large-drop waveform immediately after a small-drop waveform causes a small drop to be formed having a volume $V_{S2}$, which is different from $V_S$. Applying a small-drop waveform immediately after a large-drop waveform produces a large drop having a volume $V_{L2}$, which is different from $V_L$.

U.S. Pat. No. 8,087,740 discloses that drop formation pulses can be composed of a packet of sub-pulses. This is effective when the time between the sub-pulses is less than the response time of the drop forming device, for example when the time between the sub-pulses is less than the thermal response time of heater used as a drop forming device. In such cases, the packet of sub-pulses acts on the liquid jet as a single pulse having a leading edge corresponding to the leading edge of the first sub-pulse in the packet and a trailing edge corresponding to the trailing edge of the last sub-pulse in the packet. The centroid of the drop-forming pulse in such cases corresponds to the centroid of the integrated packet of the sub-pulses rather than to centroid of one of the sub-pulses.

The present invention permits the drop volume of the large drops and the small drops to be adjusted. In some embodiments, a plurality of sets of small-drop waveforms and large-drop waveforms are defined, each set of defined waveforms producing different print drop volumes. In one embodiment, one of the sets of small-drop waveforms and large-drop waveforms is selected and employed for printing based at least in part on the desired print drop volume. On another embodiment the flow rate of ink through the printhead nozzles is measured. Based at least in part on the measured flow rate a set of waveforms is selected for use in the printhead from the plurality of defined sets of small-drop waveforms and large-drop waveforms. In some embodiments, the selected set of waveforms is stored in the printhead. In other embodiments, the plurality of defined sets of small-drop waveforms and large-drop waveforms, are stored in memory of the printing system controller.

In another embodiment, the invention is used to reduce coverage variations across the printhead nozzle array produced by variations is nozzle geometry. From the plurality of defined sets of waveforms, one set of small-drop waveforms and large-drop waveforms is used to create drops from a first portion of the nozzle array, and a second set of small-drop waveforms and large-drop waveforms is used to create drops from a second portion of the nozzle array.

It has been found that the invention, by altering the volume of the print drop, alters the momentum of the print drop. As a result of the change in momentum of the print drop the deflection of the print drop by the drop deflection mechanism can be altered. As a result the impact location of the print drop on the print media can be altered. By appropriate use of the drop volume altering waveforms, fine adjustments can be made to the width of character strokes for improved image quality purposes. In some embodiments of the invention, the set of waveforms used for printing can include a small drop waveform and a first large-drop waveform and a second large-drop waveform. The second large-drop waveform has a period equal to the period of the first large-drop waveform, the second large-drop waveform including a large-drop forming pulse, wherein the waveform of the second large-drop waveform is distinct from the waveform of the first large-drop waveform. In certain embodiments, the centroid 186 of the drop forming pulse of the small-drop waveform is at a first time interval $T_1$ relative to the one of the endpoints of the small-drop waveform and the centroid 186 of the drop forming pulse of the first large-drop waveform is at a second time interval $T_2$ relative to the corresponding endpoint of the large-drop waveform; and where the second time interval $T_2$ is different from the first time interval $T_1$. The second large-drop waveform has a drop forming pulse having a centroid at a third time interval $T_3$ relative to the corresponding endpoint of the second large-drop waveform. The third time interval $T_3$ is different from the second time interval $T_2$.

In some embodiments of the invention, the set of waveforms used for printing can include a first small-drop waveform and a second small-drop waveform and a large-drop waveform. The second small-drop waveform has a period equal to the period of the first small-drop waveform, the second small-drop waveform including a small-drop volume-control pulse. The waveform of the second small-drop waveform is distinct from the waveform of the first small-drop waveform. The centroid 186 of the drop forming pulse of the first small-drop waveform is at a first time interval $T_1$ relative to the predetermined one of the starting endpoint and the trailing endpoint of the small-drop waveform, centroid 186 of the drop forming pulse of the second small-drop waveform is at a third time interval $T_3$ relative to the corresponding one of the starting endpoint and the trailing endpoint of the second small-drop waveform and the centroid 186 of the drop forming pulse of the large-drop waveform is at a second time interval $T_2$ relative to the corresponding starting endpoint and the trailing endpoint of the large-drop waveform.

Similarly in some embodiments of the invention the set of waveforms used include a first small-drop waveform and a second small-drop waveform and a large-drop waveform. The second large-drop waveform has a period equal to the period of the first large-drop waveform, the second large-drop waveform including a large-drop volume-control pulse. The waveform of the second large-drop waveform is distinct from the waveform of the first large-drop waveform. The centroid 186 of the drop forming pulse of the first large-drop waveform is at a first time interval $T_1$ relative to the predetermined one of the starting endpoint and the trailing endpoint of the first large-drop waveform and the centroid 186 of the drop forming pulse of the second large-drop waveform is at a second time interval $T_2$ relative to the corresponding one of the starting endpoint and the trailing endpoint of the second large-drop waveform, and the centroid of the drop forming pulse of the small drop waveform is at a third time interval relative to the corresponding one of the starting endpoint and the trailing endpoint of the small-drop waveform. The use of multiple large-drop waveforms or multiple small-drop waveforms provides more flexibility in terms of the amount of ink that can be printed on a pixel.

The invention has been described in detail with particular reference to certain preferred embodiments thereof, but it will be understood that variations and modifications can be effected within the spirit and scope of the invention.

PARTS LIST

20 Continuous Printer System
22 Image Source
24 Image Processing Unit
26 Mechanism Control Circuits
27 Drop Formation Waveforms
28 Drop Forming Mechanism
30 Printhead
32 Recording Medium
34 Recording Medium Transport System
36 Recording Medium Transport Control System
38 Micro-Controller
40 Reservoir
42 Catcher
44 Recycling Unit
46 Pressure Regulator
47 Channel
48 Jetting Module
49 Nozzle Plate
50 Plurality of Nozzles
51 Heater
52 Liquid
54 Drops
56 Drops
57 Trajectory
58 Drop Stream
60 Gas Flow Deflection Mechanism
61 Positive Pressure Gas Flow Structure
62 Gas Flow
63 Negative Pressure Gas Flow Structure
64 Deflection Zone
66 Small Drop Trajectory
68 Large Drop Trajectory
72 First Gas Flow Duct
74 Lower Wall
76 Upper Wall
78 Second Gas Flow Duct
82 Upper Wall
84 Seal
86 Liquid Return Duct
88 Plate
90 Front Face
92 Positive Pressure Source
94 Negative Pressure Source
96 Wall
98 Waveform Source
100 Small-drop Waveform
102 Drop forming Pulse
104 Leading edge
106 Centroid
108 Trailing Edge
110 Large-Drop waveform
112 Drop Forming Pulse
114 Leading edge
116 Centroid
118 Trailing Edge
120 Large-Drop Waveform
122 Drop-Forming Pulse
124 Leading edge
126 Centroid
128 Trailing Edge
130 Endpoint
140 Small-Drop Waveform
142 Drop-Forming Pulse
144 Leading edge
146 Centroid
150 Large-Drop Waveform
152 Drop-Forming Pulse
154 Leading edge
156 Centroid
160 Large-Drop Waveform
162 Drop-Forming Pulse
166 Centroid
168 Trailing Edge
170 Large-Drop Waveform
172 Drop-Forming Pulse
176 Centroid
178 Trailing Edge
180 Large-Drop Waveform
182 Drop-Forming Pulse
184 Leading edge
186 Centroid
188 Trailing Edge
190 Large-Drop Waveform
192 Drop-Forming Pulse
194 Leading edge
196 Centroid
198 Trailing Edge

The invention claimed is:

1. A method for operating a jetting module comprising:

providing a jetting module including a nozzle and a drop forming mechanism;

providing a liquid to the jetting module under pressure sufficient to cause a liquid stream to jet from the nozzle;

providing a small-drop waveform, the small drop waveform having a starting endpoint and a trailing endpoint, the small-drop waveform having a small-drop period $X_S$ equal to the time between the starting endpoint and the trailing endpoint of the small-drop waveform, the small-drop waveform including a small drop volume-control pulse, the small-drop volume-control pulse of the small-drop volume-control pulse having centroid, the centroid of the small-drop volume-control pulse being at a first defined time relative to a predefined one of the starting endpoint and the trailing endpoint of the small-drop waveform;

providing a large-drop waveform, the large-drop waveform having a starting endpoint and a trailing endpoint, the large-drop waveform having a large-drop period $X_L$, where $X_L=N*X_S$ and N is an integer greater than one, the large-drop waveform including a large-drop volume-control pulse, the large-drop volume-control pulse having centroid, the large-drop waveform having a corresponding endpoint that corresponds to the predetermined endpoint of the small-drop waveform;

wherein the centroid of the large-drop volume-control pulse being at a second defined time relative to the corresponding one of the starting endpoint and trailing endpoint of the large-drop waveform, the second defined time being different from the first defined time;

applying to the drop forming mechanism a sequence of drop formation waveforms in which:

applying a small-drop waveform after another identical small-drop waveform causes a small drop of volume Vs to be formed;

applying a small-drop waveform after a large-drop waveform causes a small drop of volume Vs2 to be formed, where $V_{S2}$ is not equal to $V_S$;

applying a large-drop waveform after another identical large-drop waveform causes a large drop of volume VL to be formed, where $V_L$~N*Vs; and applying a large-drop waveform after a small-drop waveform causes a large drop of volume VL2 to be formed, where $V_{L2}$ is not equal to $V_L$.

2. The method as in claim 1, wherein the relationship between the small drop volume $V_{S2}$ and the small drop volume $V_S$ is given by $|V_{S2}-V_S|$ is between $0.03*V_S$ and $0.3*V_S$.

3. The method as in claim 2, wherein the relationship between the small drop volume $V_{S2}$ and the small drop volume $V_S$ is given by $|V_{S2}-V_S|$ is between $0.05*V_S$ and $0.3*V_S$.

4. The method as in claim 3, wherein the relationship between the small drop volume $V_{S2}$ and the small drop volume $V_S$ is given by $|V_{S2}-V_S|$ is between $0.1*V_S$ and $0.3*V_S$.

5. The method of claim 1 wherein a plurality of sets of small-drop waveforms and large-drop waveforms are defined, each set of defined waveforms producing different print drop volumes, and one set of waveforms is selected and employed based at least in part on the desired print drop volume.

6. The method of claim 1 wherein a plurality of sets of small-drop waveforms and large-drop waveforms are defined, each set of waveforms producing different print drop volumes, wherein one set of the waveforms sets is stored on the jetting module, the stored waveform set being selected based at least in part on the flow rate of ink through the jetting module nozzle.

7. The method of claim 1 the nozzle of the jetting module is a nozzle in an array of nozzles on the jetting module wherein one set of small-drop waveforms and large-drop waveforms is used to create drops from a first portion of the nozzle array, and a second set of small-drop waveforms and large-drop waveforms is used to create drops from a second portion of the nozzle array, the first and second sets of waveforms being selected to reduce the coverage variations across the nozzle array.

8. The method of claim 1 wherein the large-drop waveform comprises a plurality of pulses, one of which is the large-drop volume-control pulse.

9. The method of claim 1 wherein the small-drop waveform comprises a plurality of pulses, one of which is the small-drop volume-control pulse.

10. The method of claim 1, wherein the predefined endpoint comprises the trailing endpoint of the waveform.

11. The method of claim 1, wherein the predefined endpoint comprises the starting endpoint of the waveform.

12. The method of claim 1 wherein the large-drop waveform comprising a first large-drop waveform and the method further comprising providing a providing a second large-drop waveform that causes the liquid stream to break up to form a large-volume drop, the second large-drop waveform having a period equal to the period of the first large-drop waveform, the second large-drop waveform including a large-drop volume-control pulse, wherein the waveform of the second large-drop waveform is distinct from the waveform of the first large-drop waveform.

13. The method of claim 12 wherein the second large-drop waveform has an endpoint that corresponds to the predefined endpoint of the small-drop waveform, the large-drop volume-control pulse of the second large-drop waveform is pulsed at a third defined time relative to the corresponding endpoint of the second large-drop waveform, the third defined time is different from the second defined time.

14. The method of claim 1 wherein the small-drop waveform comprises a first small-drop waveform, the method further comprising providing a second small-drop waveform that causes the liquid stream to break up to form a second small-volume drop when applied to the drop forming mechanism, the second small-drop waveform including a small-drop volume-control pulse, the second small-drop waveform having a period that equals the period of the first small-drop waveform, the second small-drop waveform being distinct from the first small-drop waveform.

* * * * *